US007837298B2

(12) United States Patent
Van De Wynckel et al.

(10) Patent No.: US 7,837,298 B2
(45) Date of Patent: Nov. 23, 2010

(54) PRINT HEAD MOUNTING ASSEMBLY AND METHOD FOR MOUNTING A PRINT HEAD ONTO A CARRIAGE FRAMEWORK

(75) Inventors: Werner Van De Wynckel, Wolvertem (BE); Albert Brals, Beek en Donk (NL); Bart Verhoest, Niel (BE); Bartholomeus Verlinden, Tongeren (BE)

(73) Assignee: Agfa Graphics NV, Mortsel (BE)

( * ) Notice: Subject to any disclaimer, the term of this patent is extended or adjusted under 35 U.S.C. 154(b) by 0 days.

(21) Appl. No.: 11/915,885

(22) PCT Filed: May 30, 2006

(86) PCT No.: PCT/EP2006/062706

§ 371 (c)(1),
(2), (4) Date: Sep. 11, 2009

(87) PCT Pub. No.: WO2006/128859

PCT Pub. Date: Dec. 7, 2006

(65) Prior Publication Data

US 2010/0002050 A1 Jan. 7, 2010

Related U.S. Application Data

(60) Provisional application No. 60/692,199, filed on Jun. 20, 2005.

(30) Foreign Application Priority Data

May 30, 2005 (EP) ..... 05104627

(51) Int. Cl.
*B41J 2/15* (2006.01)
*B41J 1/145* (2006.01)

(52) U.S. Cl. ..... 347/40; 347/37; 347/86

(58) Field of Classification Search ..... 347/40–43, 347/20, 67, 85–86, 108
See application file for complete search history.

(56) References Cited

U.S. PATENT DOCUMENTS 5,880,757 A 3/1999 Ta et al.

(Continued)

FOREIGN PATENT DOCUMENTS

EP 1 674 279 A1 6/2006

OTHER PUBLICATIONS

Official communication issued in the International Application No. PCT/EP2006/062706, mailed on Aug. 23, 2006.

(Continued)

*Primary Examiner*—Thinh H Nguyen
(74) *Attorney, Agent, or Firm*—Keating & Bennett, LLP

(57) ABSTRACT

A print head mounting assembly and a method of mounting and positioning a print head on a print head carriage framework suitable for mounting in a printing system includes a print head positioning device for receiving a print head, and a print head mounting tile having a mounting surface for mounting the print head positioning device. The print head mounting tile is adjustably mounted on the print head carriage framework such that it provides a mounting surface for the print head positioning device that is level with a reference printing surface, when the print head carriage framework is mounted in the printing system. The print head positioning device is adjustably mounted on the print head mounting tile such that the print head, being received in the print head positioning device, is accurately positioned on the mounting surface of the print head mounting tile.

12 Claims, 8 Drawing Sheets

U.S. PATENT DOCUMENTS

| | | | | |
|---|---|---|---|---|
| 6,796,630 | B2 | 9/2004 | Ison et al. | |
| 7,018,027 | B2 * | 3/2006 | Harada et al. | 347/86 |
| 2003/0128254 | A1 | 7/2003 | Ison et al. | |

OTHER PUBLICATIONS

Verlinden et al.; "A Print Head Shuttle With Active Cooling"; U.S. Appl. No. 11/915,890, filed Nov. 29, 2007.

* cited by examiner

PRINT HEAD MOUNTING ASSEMBLY AND METHOD FOR MOUNTING A PRINT HEAD ONTO A CARRIAGE FRAMEWORK

CROSS-REFERENCE TO RELATED APPLICATIONS

This application is a 371 of PCT/EP2006/062706, filed May 30, 2006. This application claims the benefit of U.S. Provisional Application No. 60/692,199, filed Jun. 20, 2005, which is incorporated by reference. In addition, this application claims the benefit of European Application No. 05104627.4, filed May 30, 2005, which is also incorporated by reference.

BACKGROUND OF THE INVENTION

1. Field of the Invention

The present invention relates to a solution for mounting and positioning a print head onto a print head carriage framework. More specifically, the present invention is related to a mounting assembly for accurately mounting an inkjet print head onto a less accurate print head carriage framework.

2. Description of the Related Art

In industrial printing applications, print throughput is an important characteristic of a printing device. One of the parameters determining print throughput in digital printers using a reciprocating print head configuration, e.g., wide format ink jet printers, is the size of the print head shuttle. The wider the print head shuttle is, the wider the area on the printing medium is that may be printed with a single print stroke or pass of the print head shuttle across the printing medium. Several problems arise when using larger print head shuttles in digital printer configurations. As print head shuttles get larger, they get heavier which complicates fast and accurate movement of the shuttle. As print head shuttles get larger, the left and right abutments of the shuttle on the printer frame diverge and the shuttle structure becomes more susceptible to bending and torsion. As print head shuttles get larger, the print width of a single print stroke increases and the throw-distance, defined as the distance between the print head's printing elements (e.g., the ink jet nozzles) and the print surface of the printing medium across the entire print stroke become more difficult to control within acceptable tolerances. Additionally, as print head shuttles get larger, they carry more print heads and accurate positioning of the print heads over the full width of the shuttle becomes more difficult.

These are just some of the problems that arise when scaling up existing print head shuttle concepts for industrial type printing equipment.

In view of the problems mentioned above, the inventors of the present application have discovered that it would be advantageous to have a method of mounting a print head onto a shuttle that relaxes the manufacturing tolerances of the shuttle without compromising mounting accuracy of the print heads relative to each other and to a printing surface.

SUMMARY OF THE INVENTION

In order to overcome the problems described above, preferred embodiments of the present invention provide a print head mounting assembly having specific features and a method of mounting a print head as described below. With the print head mounting assembly according to preferred embodiments of the present invention, the manufacturing tolerances of the print head carriage framework can be narrowed down to a range suitable for accurately position print heads using known print head positioning devices.

Other features, elements, processes, steps, characteristics and advantages of the present invention will become more apparent from the following detailed description of preferred embodiments of the present invention with reference to the attached drawing.

DETAILED DESCRIPTION OF PREFERRED EMBODIMENTS

While the present invention will hereinafter be described in connection with preferred embodiments thereof, it will be understood that it is not intended to limit the invention to those preferred embodiments.

One Preferred Embodiment of a Digital Printer

Figure 1:
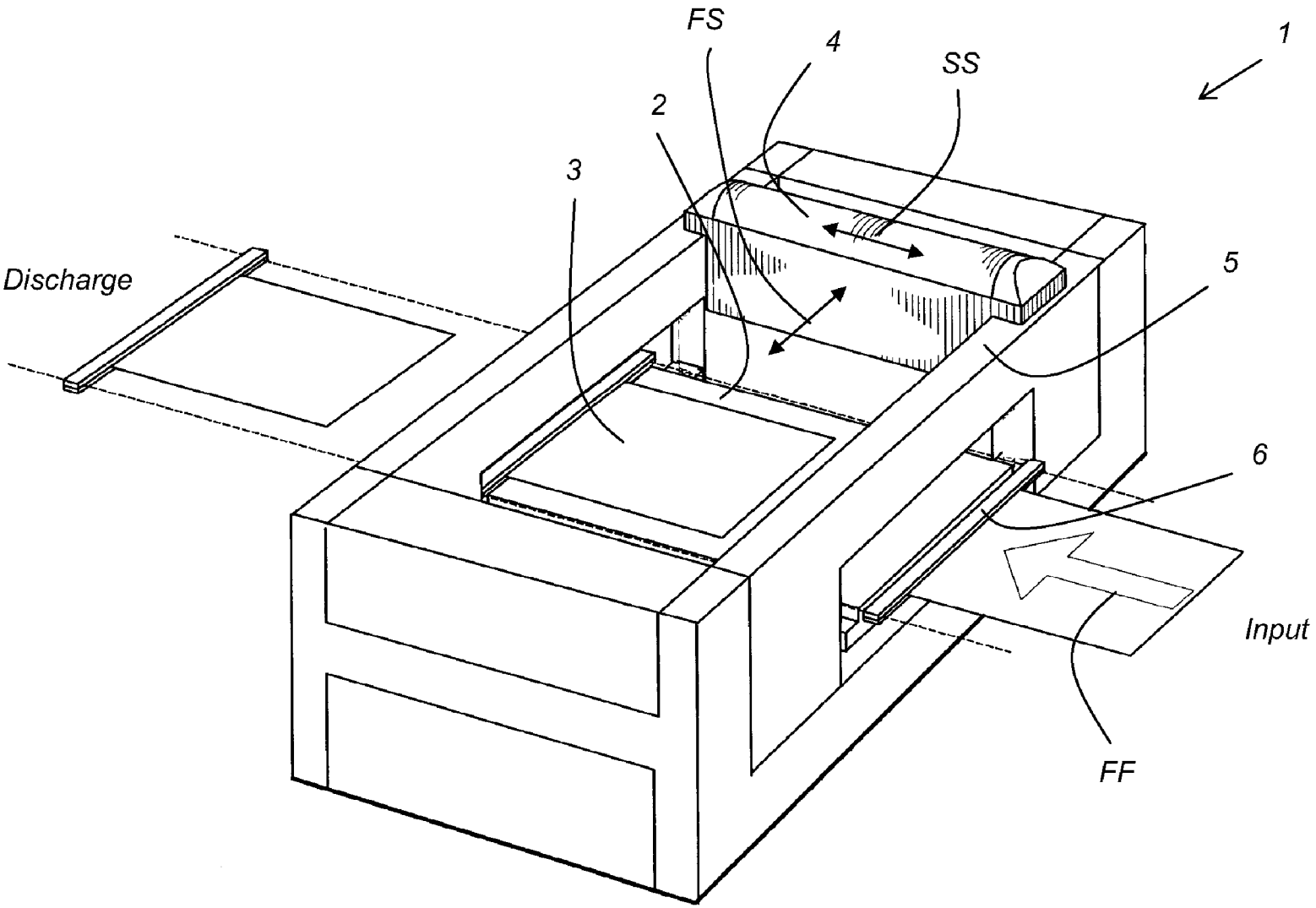
FIG. 1 shows a perspective view of a digital printer using a print head shuttle according to a preferred embodiment of the present invention.

A digital printer according to a preferred embodiment of the present invention is shown in FIG. 1. The digital printer 1 includes a printing table 2 arranged to support a printing medium 3 during digital printing. The printing table is substantially flat and can support flexible sheet media with a thickness as low as tens of micrometers (e.g., paper, transparency foils, adhesive PVC sheets, etc.), as well as rigid substrates with a thickness up to some centimeters (e.g., hard board, PVC, cartons, etc.). A print head shuttle 4, including one or more print heads, is designed for reciprocating back and forth across the printing table in a fast scan direction FS and for repositioning across the printing table in a slow scan direction SS substantially perpendicular to the fast scan direction. Printing is performed during the reciprocating operation of the print head shuttle in the fast scan direction. Optional repositioning of the print head shuttle is performed in between reciprocating operations of the print head shuttle in order to position the print head shuttle in line with a non-printed or only partially printed area of the printing medium. The repositioning of the print head shuttle is unnecessary in situations where the print head shuttle is equipped to print a full-width printing medium in a single fast scan operation. During printing, the printing table, and supported thereon the printing medium, remains in a fixed position. A support frame 5 guides and supports the print head shuttle during its reciprocating operation. A printing medium transport system can feed individual printing sheets into the digital printer along a sheet feeding direction FF that is substantially perpendicular to the fast scan direction of the print head shuttle, as shown in FIG. 1. The printing medium transport system is designed as a "tunnel" or "guide through" through the digital printer, i.e., it can feed media from one side of the printer (the input end in FIG. 1), position the sheet on the printing table for printing, and remove the sheet from the printer at the opposite side (the discharge end in FIG. 1).

As an alternative to using a sheet-based medium transport system, e.g., a gripper bar transport system 6 known from automated flat bed screen printing presses as indicated in FIG. 1, the digital printer may also be used with a web-based medium transport system. The printing medium transport may feed web media into the digital printer from a roll-off at the input end of the digital printer to a roll-on at the discharge end of the digital printer. Inside the digital printer, the web is transported along the printing table that is used to support the printing medium during printing. In the particular case of a web-based medium transport with a printing medium feeding direction equal to the slow scan direction, the repositioning of the print head shuttle along the slow scan direction may be replaced by a repositioning of the web in the feeding direction. The print head shuttle then only reciprocates back and forth across the web in the fast scan direction.

Preferred embodiments of the present invention may also be used in single pass printing systems where the print heads are fixed and the printing medium moves along the print heads. In this alternative printer configuration, a shuttle as depicted in FIG. 1 is replaced by a print head carriage mounted fixedly on the support frame. Sheet media or web media is fed in a direction FS underneath the fixed print head carriage frame and is printed in a single pass.

Shuttle Structure

Figure 2:
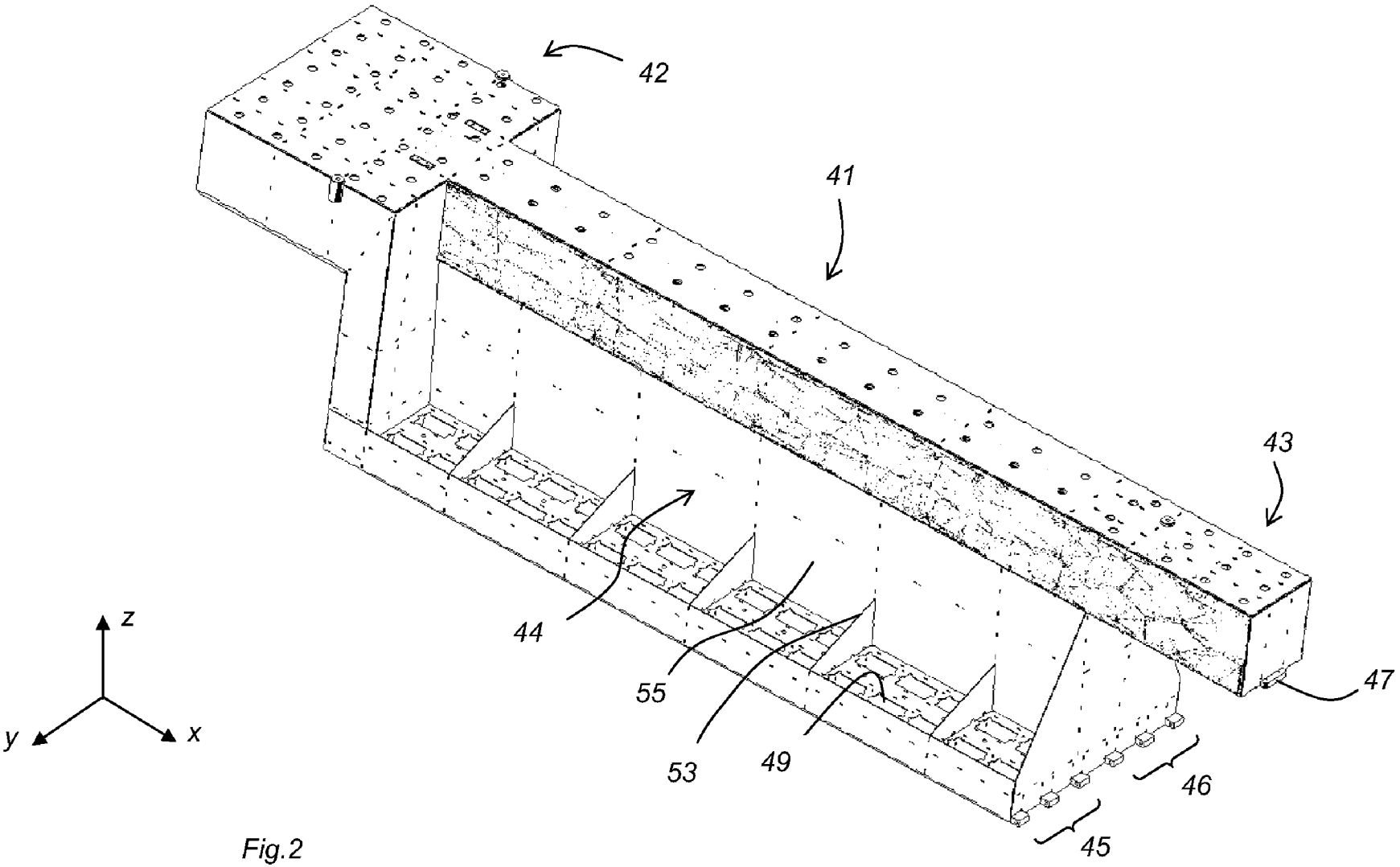
FIG. 2 shows a perspective view of a print head shuttle incorporating a preferred embodiment of the present invention.

As shown in FIG. 1, the print head shuttle in the present preferred embodiment of a digital printer is guided and supported by a support frame. The support frame preferably is a double beam construction that supports the print head shuttle at each end and over the full length of the fast scan movement. A print head shuttle that may be used in the digital printer of FIG. 1 is shown in FIG. 2. The print head shuttle 4 has a central bridge 41 between a left supporting end 42 and a right supporting end 43. A print head carriage 44 hangs underneath the bridge 41. The print head carriage is divided into a front portion 45 and a rear portion 46. The carriage is provided with print head locations 49 for mounting a total of 64 print heads in a matrix of 4 by 16, i.e., 4 print heads behind each other in the fast scan direction or y-direction and 16 print heads next to each other along the slow scan direction or x-direction. The 64 print head locations are equally divided over the front portion and rear portion of the carriage. The print head locations in the fast scan direction, i.e., four locations in line, may be used to simultaneously print four colors in a single fast scan movement of the print head shuttle, e.g., to print full process colors in one pass by simultaneously printing Cyan, Magenta, Yellow and blacK colors. The sixteen print head locations next to each other along the slow scan direction allow the print head shuttle to span a substantial width of the printing medium.

The width along the x-direction of the print head carriage of the shuttle shown in FIG. 2 is about 2 m and is chosen to cover the width of the printing table along the x-direction. Therefore, printing sheets may be printed in their full width. The depth along the y-direction of the print head carriage is about 0.5 m, for example. The height of the print head shuttle carriage, not including the bridge, is also about 0.5 m, for example.

Shuttle Construction

The entire print head shuttle may be designed as a framework or skeleton of sheet metal parts. The sheet metal parts may be positioned in the framework by paired pen and slot portions and welded together. Sheet metal parts have the advantage that they often are lighter than machined parts. Furthermore, sheet metal technology is easy to create framework structures with and it allows inserts to be designed that increase the overall stiffness of the framework against bending, torsion, vibrations, etc.

Figure 3A:
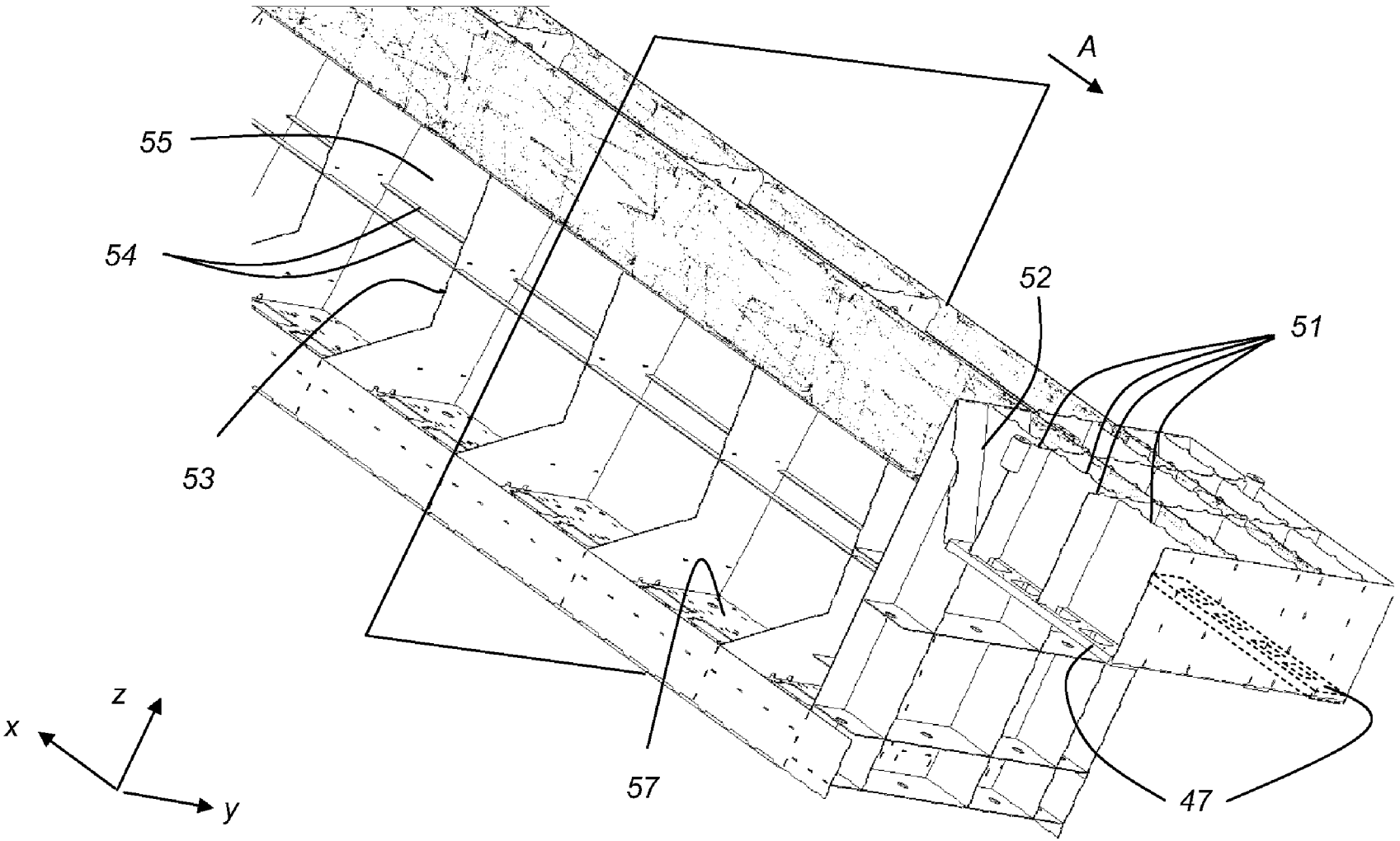
FIG. 3A shows a perspective view of the print head shuttle framework.
Figure 3B:
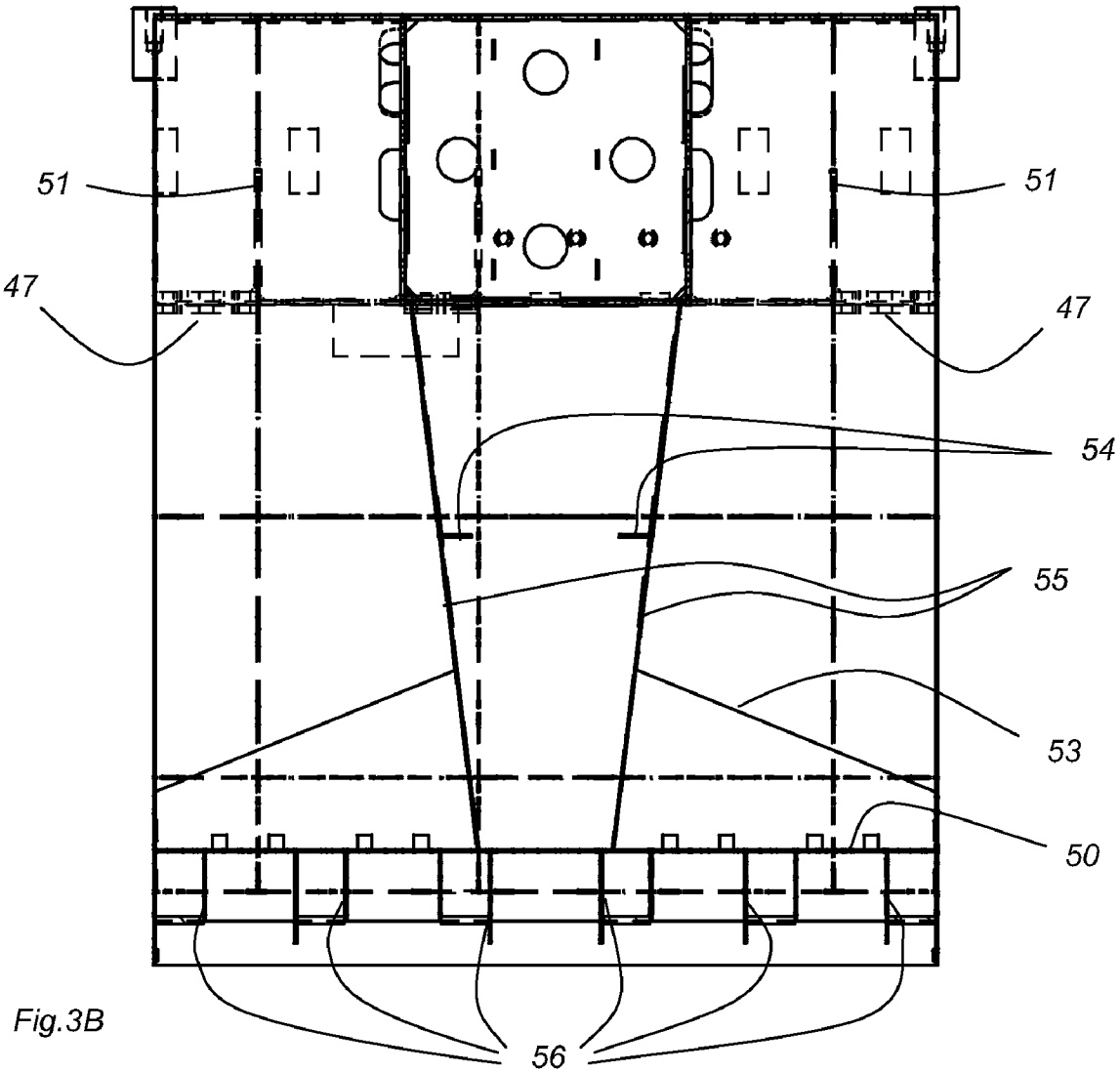
FIG. 3B shows a cross-section view of the print head shuttle framework.

FIG. 3A shows some details of the shuttle framework that increase the overall stiffness of the structure. In this figure, some external portions have been removed to get a view of the internal structure. The accompanying FIG. 3B is a cross-sectional view of FIG. 3A through plane A as shown.

FIG. 3A shows a supporting end of the print head shuttle where two mounting bases 47 for mounting linear slides are provided. One of the mounting bases is drawn in dashed lines because it is invisible in the view of FIG. 3A. The mounting bases are mounted on ground surfaces of the framework. At these locations, the framework is stiffened using a perpendicular or substantially perpendicular construction 51 of sheet metal parts. These sheet metal parts create a substructure that firmly anchors the linear slides to the entire framework of the print head shuttle.

Between the supporting end of the print head shuttle and the side wall of the print head carriage, additional diagonal sheet portions 52 are used to stiffen the corner of the framework. The stiffness of the corner plays an important roll in passing on a torque moment of the print head framework around the x-axis to the abutments of the shuttle onto the printer frame, without introducing horizontal shear components at the abutments. The stiffness of the corner is therefore an important prerequisite.

The vertical partitions 53 oriented substantially perpendicular to the x-axis and positioned at regular distances along the x-axis provide additional resistance against bending of the print head carriage. These partitions extend from the front 45 of the carriage to the back 46 of the carriage in a yz-plane and are attached to multiple substantially vertical oriented sheet portions of the print head carriage in an xz-plane. They create additional substantially perpendicular substructures to increase overall stiffness of the print head shuttle.

At a halfway point of the print head carriage height, substantially horizontally oriented strips 54 are attached to the substantially vertically oriented carriage walls 55 over the full width of the print head shuttle. The strips provide additional stiffness to the relatively high vertical walls of the carriage and increase the eigenfrequency of these walls by dividing the free wall surface in two.

In between the rows of print head locations at the bottom of the print head carriage, rectangular beams 56 are mounted along the full width of the print head carriage in the x-direction to provide additional bending and torsion resistance to the bottom area of the carriage. The rectangular beams are linked together via plate 50, as shown in FIG. 3B. This is the area where the print heads are mounted and therefore the stiffness of this area is very important. In view of print head position and orientation tolerances, it is important to preserve the straightness in this area of the sheet metal framework. This is achieved by increasing the stiffness in this area of the sheet metal framework with these rectangular beams.

The present preferred embodiment of the print head shuttle framework, of which some aspects have just been discussed in detail, and with dimensions as given before yields a sheet metal framework weighing about 200 kg, for example. A fully loaded print head shuttle, including 64 print heads and all necessary supplies that need to shuttle along with the print heads, weighs at least 300 kg, for example. It is clear that this size and weight of print head shuttles creates special concerns regarding bending, torsion, vibrations, etc. The design features discussed above provide answers to these concerns.

Figure 4:
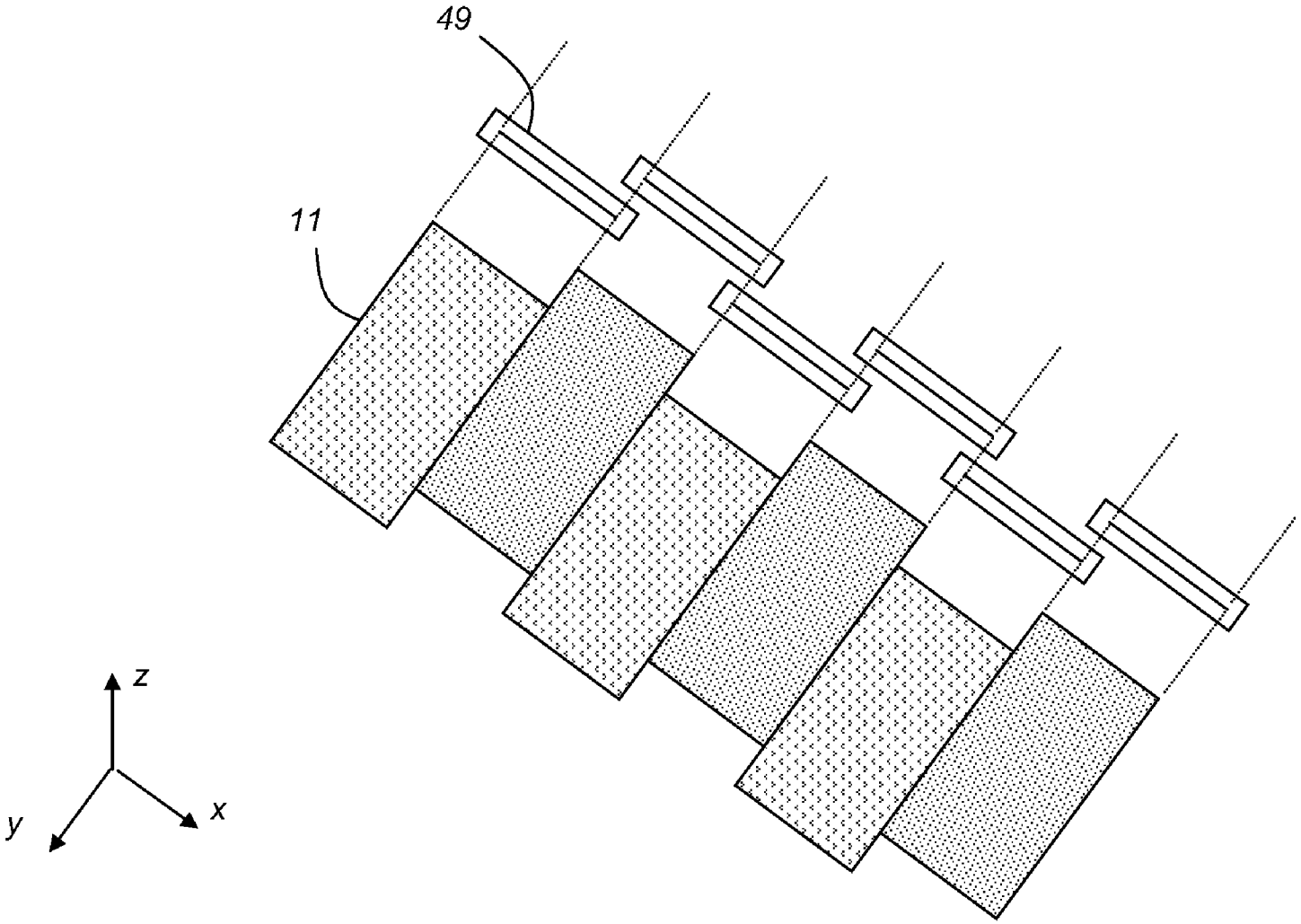
FIG. 4 shows an alternative preferred embodiment of print head locations on the print head shuttle.

In the preferred embodiment shown in FIG. 2, sixteen print heads may be positioned next to each other to span the full width of the printing medium. The sixteen swaths that can be printed with a single fast scan movement of the sixteen print heads may span the full width of the printing medium, but do not provide a full width printed image in a single fast scan movement because the print swaths do not join up along the x-direction. In order to be able to print a full width image in a single pass of the print head shuttle, or alternatively in a single pass of the printing medium past a fixed print head configuration, and thus reduce printing time and increase throughput and productivity, an alternative preferred embodiment of a print head shuttle may be provided with staggered print head locations. The staggering may be realized so as to make printed swaths from the staggered print heads join each other. An example is shown FIG. 4 wherein six print heads 49 are not located in one line along the x-direction but are staggered in two rows along the x-direction. The staggering allows the printed swaths 11 of the print heads to join up as a single full width printed image. In the print head shuttle of FIG. 2, the sixteen print head locations along the x-direction are chosen so as to provide printed swaths on the printing medium separated from each other with a distance substantially equal to a print swath width. This set-up has the advantage that straightforward interlacing techniques can be used to fill in the non-printed swaths by moving the print head shuttle over a distance along the slow scan direction substantially equal to a print swath width, between two fast scan movements of the print head shuttle.

In the present preferred embodiment, the entire print head shuttle is made of a framework of sheet metal parts providing a light and stiff construction. Other print head shuttle constructions or the use of other materials may also provide similar properties. An alternative may, for example, be a framework of machined aluminum parts with sheet metal parts. The machined aluminum parts may provide features that are difficult to provide in sheet metal. The framework may also include synthetic materials that are light-weight, possibly reinforced to add stiffness. One common aspect of these preferred embodiments is that a substantial portion of the print head shuttle construction is a framework.

Print Head Positioning

The flatness accuracy of a sheet metal framework of a size of the print head shuttle as described above is typically only a few millimeters. The 3D positioning of print heads in the print head shuttle however needs to be within micrometers and milliradians in order to achieve an acceptable droplet landing position accuracy, and linked therewith print quality. The droplet landing is critical in ink jet printing because digital images are printed as individual pixels on a predefined raster. Any deviation of a pixel from that raster is a printing error and may be visible to the human eye.

Digital printers generally use multiple print heads, all of them mounted on a single shuttle or carriage. They may be mounted on a common base plate of the shuttle or carriage by print head positioning devices. The base plate may, for example, be the sheet metal portion of the print head shuttle described above, having a cutout at each print head location. Examples of print head positioning devices have been described in U.S. Pat. No. 6,796,630 to R. Ison et al. and European Patent Application No. 04106837.0, which is incorporated herein by reference. Print head positioning devices may include features to adjust the position of the print heads relative to some reference data on the base plate itself or on a portion of the printer frame. These position adjustment features are designed to be very accurate, but are limited in their adjustment range. This range often is insufficient to compensate for manufacturing tolerances, e.g., flatness of the base plate, which may be in the range of millimeters for large constructions.

Figure 5B:
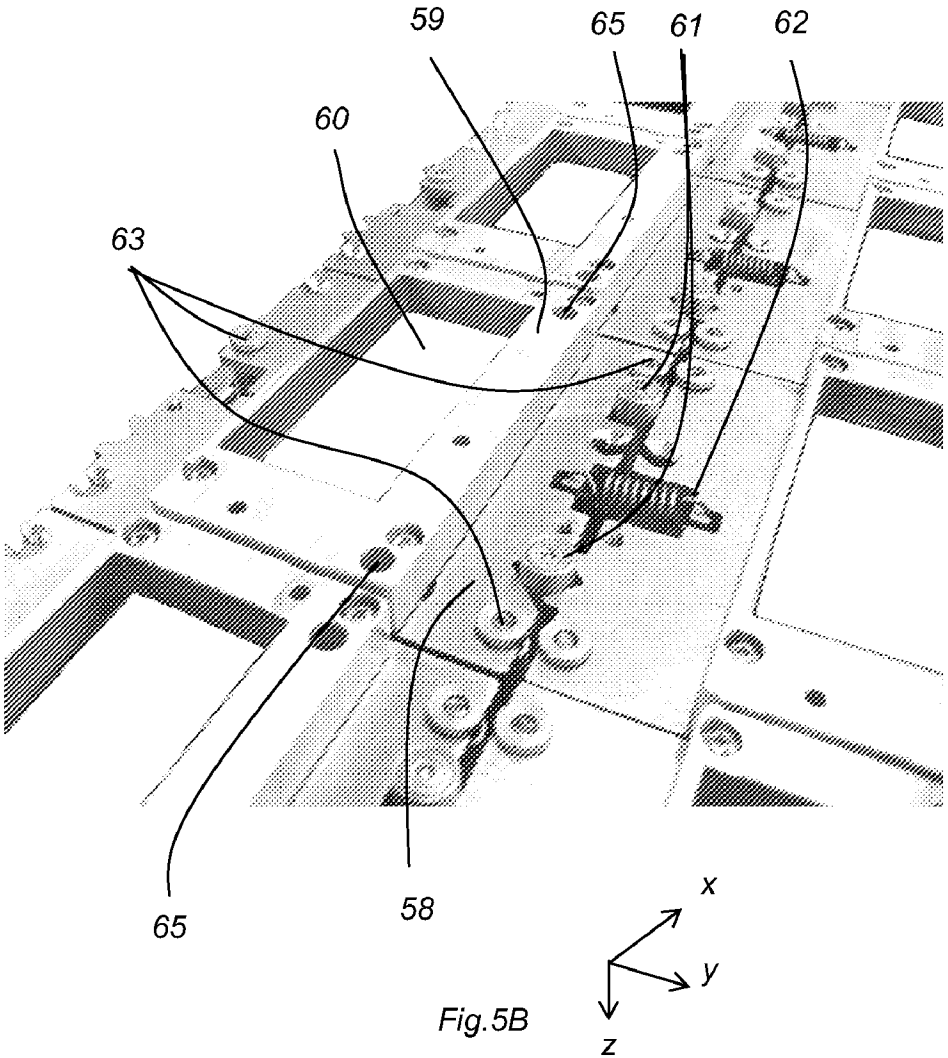
FIG. 5B shows a perspective view of the print head positioning system.
Figure 5A:
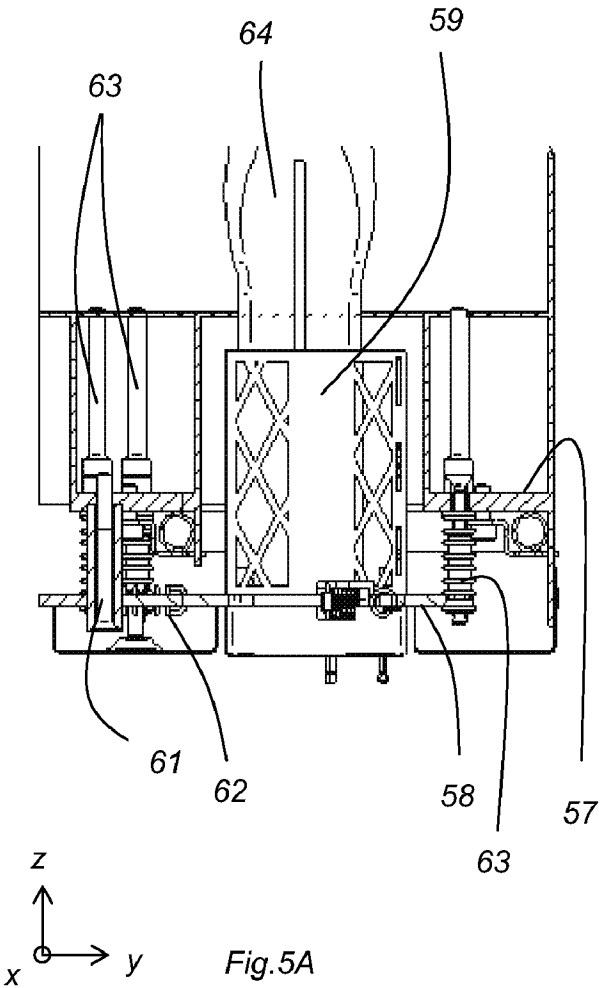
FIG. 5A shows a cross-sectional view of a print head positioning system used with the print head shuttle framework.

The problem of specification incompatibility between the flatness of a mounting plate, e.g., the sheet metal base plate of the print head shuttle framework, and the print head position accuracy in 3D space, is solved by providing a mounting assembly as illustrated in the FIGS. 5A and 5B. FIG. 5A is a cross-sectional view of a portion of the print head carriage as described before. The figure shows only one print head location. The bottom of FIG. 5A is facing the printing medium, as is illustrated by the co-ordinate system in FIG. 5A. FIG. 5B is a perspective view of a series of print head locations in the print head carriage, viewed from the printing medium side towards the print head carriage. The mounting assemblies illustrated in FIGS. 5A and 5B include an additional print head mounting tile 58 for each print head location. So, in a print head shuttle including 64 print head locations, 64 tiles are provided. Each individual tile takes over the mounting functionality and mounting references for a corresponding print head positioning device from the base plate 57. Each tile is mounted onto the base plate using positioning devices that may be controlled in three dimensions such that large manufacturing tolerances on the base plate may be reduced to narrow position tolerances on the tile. Therefore, the tile's positioning devices allow narrow position tolerances to be set on the tile itself such that accurate print head positioning, according to specifications of the ink jet printing process, is feasible within the operating range of the print head positioning device.

The tile 58 may be manufactured from a stainless steel plate or any other suitable material. The tile has a cutout 60, inline with the cutout in the base plate 57, through which a print head may be positioned. The tile 58 may be moveably fixed to the base plate 57 by spring loaded adjustment screws 63 and using mechanical reference data on the tile 58 and base plate 57. In a particular preferred embodiment, the tile's xy-position is determined by two bushings 61, one cooperating with a V-groove type datum on the tile and the other cooperating with a straight datum on the tile. The tiles are secured against these bushings by a spring 62. In the preferred embodiment shown in FIG. 5B, two tiles are using the same bushings and are secured with the same spring. The locations on the base plate where the bushings are mounted have been ground to allow a substantially upright position of the bushings in the z-direction. This upright position of the bushings guarantees a correct xy-position of the tile, independent of the tile's z-position along the bushings. The planar position of the tile relative to the base plate may be adjusted using three spring loaded screws 63. The screws are operable from both sides of the mounting assembly, i.e., from the bottom side or printing side of the print head, and from the top side or supply side of the print head. The bushings 61 with cooperating mechanical data on the tile, the spring 62, and the screws 63, allow the tile to be positioned in 3D space such that mechanical mounting references on the base plate 57 are transferred to the tile 58 and manufacturing tolerances of the base plate 57 are narrowed down to position tolerances of the tile 58 that are within range of the position adjustment features of the print head positioning device 59 used for fine tuning the position of the print head 64 received in the print head positioning device 59.

A print head positioning device 59 is moveably mounted on each tile 58. The position of the print head positioning device 59 relative to the tile 58 can be adjusted by two spring loaded adjustment screws 65. The adjustments take place in a coplanar manner relative to the mounting surface of tile 58 onto which the print head positioning device 59 is mounted. In FIG. 5A, this mounting surface is substantially parallel with the xy-plane of the coordinate system shown. The mounting surface can be made substantially parallel with the xy-plane by three spring loaded screws 63 as described above. Via a lever system (not shown), a first screw 65 is used to adjust the position of the print head positioning device along the x-direction while a second screw 65 is used to adjust the angular position of the print head positioning device in the xy-plane. With the positioning of the print head positioning device 59 onto the tile 58 and indirectly onto the base plate 57, the position of the print head 64 that is received and fixed in the print head positioning device 59 is also determined. Details of the position adjustment possibilities of the print head positioning device may be found in European Patent Application No. 04106837.0, incorporated herein by reference. The screws 65 may be operated from opposite sides, i.e., from the bottom side or printing side of the print head, and from the top side or supply side of the print head.

The particular preferred embodiment of a mounting assembly as described above may be used as follows. In a first step, the print head mounting tile 58 is mounted onto the base plate 57 of the print head carriage framework 44. Its position is adjusted such that the mounting surface of tile 58, onto which the print head positioning device will be mounted, is level with a reference printing surface. This reference printing surface may be the surface of the printing table 2 of the digital printer 1. A reference printing surface may also be established offline, i.e., when the print head carriage framework 44 is not mounted in the printing system 1, by referring to the mechanical references 47 used to mount the print head carriage framework 44 onto the support frame 5 of digital printer 1. The print head carriage framework 44 may also be mounted on a calibration table, in which case the surface of the calibration table may serve as the reference printing surface. In the drawings, a reference printing surface is parallel with the xy-plane of the coordinate system. The position of the tile 58 coplanar with the reference printing surface is controlled by the bushings 61, the mechanical data on the tile, and the spring 62. In a particular preferred embodiment, the position accuracy of the tile's xy-position coplanar with the reference printing surface may be within 0.2 mm and it's levelness with the reference printing surface within 20 μm, for example.

The print head positioning device 59 is then mounted onto the print head mounting tile 58. Its position, relative and coplanar with the mounting surface of the tile and therefore substantially parallel with the reference printing surface, is adjusted with a resolution of the positioning device (e.g., the lever system mentioned above) associated with adjustment screws 65. In a particular preferred embodiment, the print head positioning device may be positioned with a resolution of about 3 μm and an accuracy of about ±5 μm relative to a fixed reference on the print head carriage 44 or relative to a neighboring print head positioning device, for example. In the specific embodiment of the print head positioning device disclosed in European Patent Application No. 04106837.0, the print head's printing surface (e.g., the ink jet nozzle plate) inherits the levelness of the tile 58 and the position of the print head positioning device 59. A levelness of the print head's printing surface of less than 20 μm and an xy-position accuracy of the print head better than about ±3 to ±5 μm is sufficient for high quality ink jet printing, for example.

If the adjustment range of screws 65 of print head positioning device 59 is insufficient to compensate for the inaccuracy of the position of the print head mounting tile 58 onto the base plate 57 or print head carriage 44, the print head's printing surface cannot be positioned to provide acceptable print quality. Then, additional positioning devices are required that bridge the tolerance gap between the base plate 57 or print head carriage frame 44 and the print head's printing surface. In inkjet printing, additional positioning devices may be provided by changing the range of operational inkjet printing nozzles within the range of an available inkjet printing nozzle in the inkjet print head. If, for example, an inkjet print head has 764 nozzles arranged in an array with an inter-nozzle distance (nozzle pitch) of 1/360 inch, a print width of 2 inches may be achieved with a contiguous set of 720 operational nozzles of the 764 nozzles. The contiguous set may be selected via software or firmware in the print head control circuitry. A shift of the selection with one nozzle yields another contiguous set of 720 operational nozzles of which the x-position is shifted 1/360 inch without adjusting the print head positioning device 59 or the mounting tile 58. Therefore, if not all the nozzles in an inkjet print head are operational during printing, a proper selection of the operational set of nozzles provides additional position adjustment of the final pixels on the printing medium, i.e., a position adjustment of a multiple of the nozzle pitch for the printed pixels on the printing medium. A proper selection of the operational set of nozzles in a print head may reduce the required range for adjustability of the position of the print head positioning device in the x-direction to one nozzle pitch distance, i.e. from −½ the nozzle pitch to +½ the nozzle pitch. This approach is especially advantageous in situations where high position accuracy and a wide adjustability range are required.

Other preferred embodiments of print head mounting and positioning methods and assemblies may be thought of that close the gap between inaccurate sheet metal frameworks and very accurate print head position specifications. The multitude of position adjustment devices used in the preferred embodiments, such as screws, bushings and springs, acting in multiple directions and controlling multiple relative positions between individual parts of the assembly may be replaced by other position adjustment devices known in the art or operate between other parts of the assembly without departing from the concept of using intermediate tiles and/or print head positioning devices to increase the print head position accuracy and finally the printed pixel position on the printing medium.

Thermal Stability

In the prior art it is known that the ink temperature of hot melt inks or UV-curable inks in ink jet printing processes is an important print quality and print reliability determining parameter. Multiple approaches have been described to control the ink temperature in these ink jet processes, both in the ink supply and in the ink jet print head. It has also been known in the prior art that local heat generation by activating individual ink jet chambers of the ink jet print head may disturb the heat management and influence the printing process, e.g., the droplet size may change. Already a number of solutions have been provided to control the temperature of the ink that is to be jetted by the ink jet print head, at the level of the ink supply as well as at the print head level.

Figure 6A:
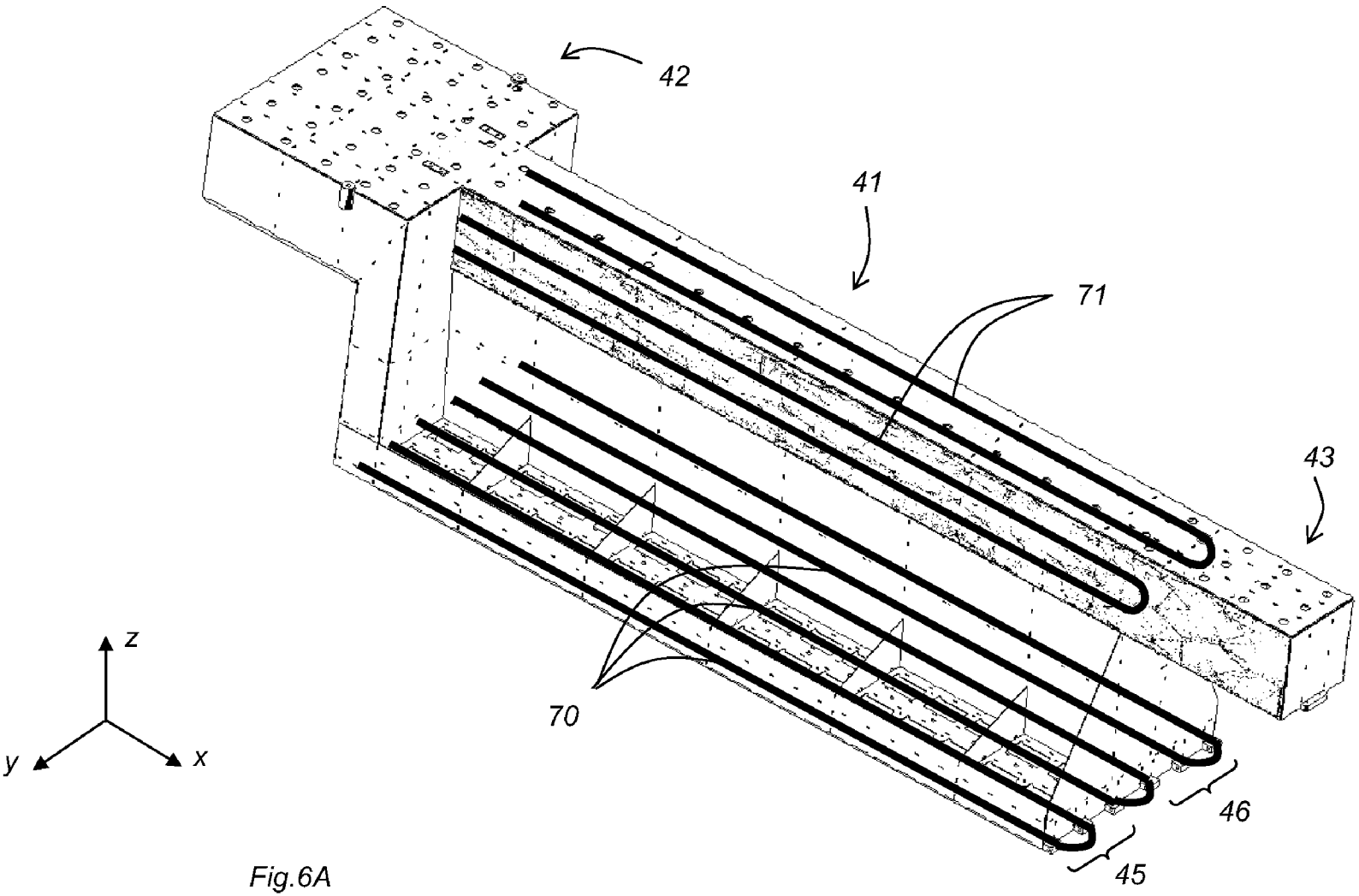
FIG. 6A shows the location of cooling channels for the print head shuttle framework.
Figure 6D:
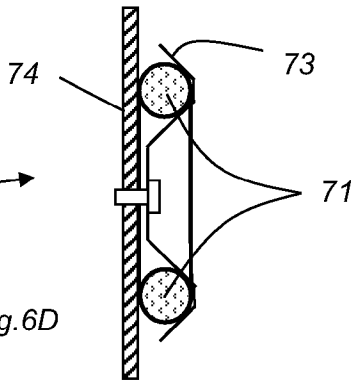
FIG. 6D shows details of the bridge cooling channels.
Figure 6C:
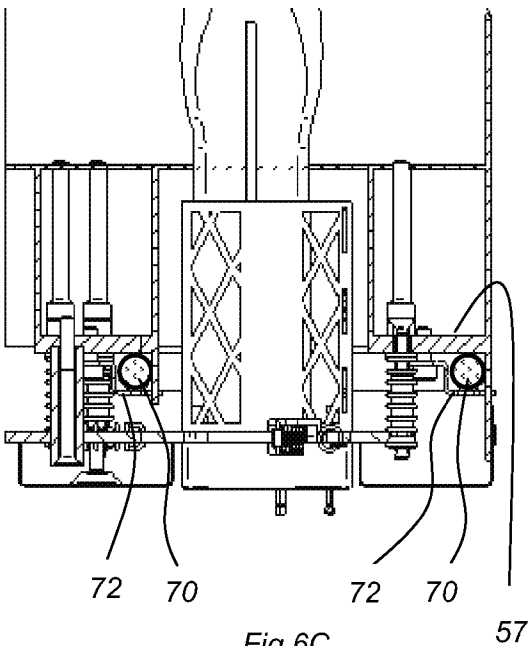
FIG. 6C shows details of the base plate cooling channel locations.
Figure 6B:
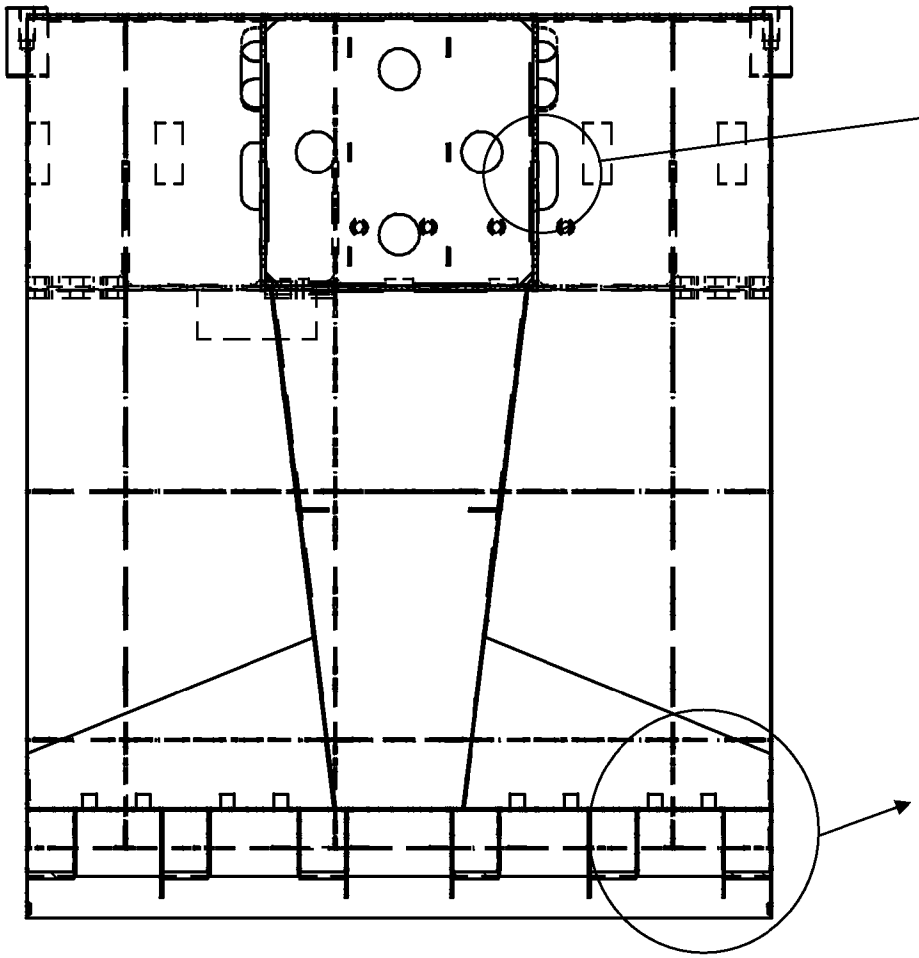
FIG. 6B shows an indication of the locations of the cooling channels on a cross-sectional view of the print head shuttle framework.

A problem of thermal stability in ink jet printers, not often addressed in the prior art, is the thermal stability of the mounting frame or print head shuttle, especially the thermal stability of the references on the frame or shuttle that are used for precisely positioning of the print head. Temperature variations in mechanical structures introduce stresses that cause dimensional instability of the structure. In a mounting or print head shuttle framework, temperature variations in the mechanical structure may be introduced through parts of an ink supply system that are operated at an elevated temperature, e.g., UV-curable ink supplied at 45° C. or hot melt inks supplied at temperatures of about 100° C. and more. Temperature variations may also be introduced by the operation of radiation-curing or drying units that reciprocate back and forth together or synchronous with the print heads in the head shuttle for curing or drying the ink right after jetting. It is known that, for example, UV-curing systems not only radiate UV light but also radiate a substantial amount of IR light. The IR light scatters around and heats up the surrounding structures, including the print head shuttle framework. Heating of the print head shuttle framework may lead to positional drift of the print head positioning references of the framework. A solution to positional drift is provided by actively cooling the shuttle framework at locations contributing to the dimensional stability of the print head positioning references. FIG. 6A shows locations where active cooling channels may be provided in the sheet metal framework of the print head shuttle described above. In this figure, the print head shuttle itself is shown as a transparent model onto which the locations of the active cooling channels are drawn. Three base plate cooling channels 70 are located near the bottom of the print head carriage and are in thermal contact with the base plate. The base plate channels may provide cooling to counter a temperature rise of the base plate by scattered IR light of the curing units or other heat sources in that region of the print head carriage. Two bridge cooling channels 71 are attached to the bridge at locations where a utility bar for distributing and/or collecting heated ink to the ink jet print heads is mounted. The channels 71 are located in between the utility bar and the bridge and prevent heat transfer from the utility bar to the sheet metal framework of the bridge. FIG. 6B shows a cross-section, perpendicular to the x-axis, of the print head shuttle shown in FIG. 6A. FIGS. 6C and 6D are details showing the location of the cooling channels. FIG. 6C shows a cross-sectional view of the location of the base plate cooling channels 70 along a line of print head locations in the rear portion 46 of the print head shuttle. The view in FIG. 6C is similar to that of FIG. 5A. The base plate 57 is shown onto which the print head mounting tiles 58 and the print head positioning devices 59 are mounted. Cooling channels 70 are provided in thermal contact with the base plate 57 at either side of the print head row. They are attached using brackets 72. Referring back to the overview of FIG. 6A, a cooling channel 70 is provided before the first row of print head locations at the front portion 45 of the print head shuttle, in between the first and the second row of print head locations, and behind the second row of print head locations. A similar configuration is provided at the rear portion 46 of the print head shuttle. FIG. 6D shows a cross-sectional view of the location of the bridge cooling channels 71. The cooling channels 71 are mounted with brackets 73 onto a sheet metal plate 74 of the bridge 41.

In this preferred embodiment of print head shuttle cooling channels, copper pipes are preferably used with an internal diameter of 8 mm. However, cooling channels may also be implemented using alternative concepts. These alternatives may include machined rectangular channels or extruded parts that are fixed to the sheet metal parts of the print head framework to form a sandwich of sheet metal parts with cooling channels. The bridge cooling channels may be located at the inside of the bridge or may be mounted at the outside. The cooling channels may also be manufactured from other materials than copper.

Any type of cooling fluid known in the art may be used, including water. The cooling channels, in order to drain heat energy from locations on the print head shuttle that are critical for the dimensional stability of the structure, are preferably linked to a supply of cooling fluid. The supply system preferably is a closed loop circulation system including a heat exchanger to withdraw heat from the cooling fluid. The flow rate of the cooling fluid in the circulation system may be adjustable. Given the mechanical implementation of the cooling circuits in the print head shuttle, the heat exchanger settings and the cooling fluid flow rate may be used to control the cooling efficiency and therefore control the temperature of the print head shuttle framework.

In the majority of applications, the print head shuttle will need active cooling to control its temperature at a number of locations. However, the cooling circuits may also be used to heat the print head shuttle at locations along the cooling circuits. It is important that a number of locations of the print head shuttle can be temperature controlled to preserve the dimensional stability of the framework and of the print head shuttle.

Print Head Shuttle Mounting

Referring to FIG. 2, one supporting end of the print head shuttle is larger than the other. At the bottom of the left supporting end of the print head shuttle, the print head shuttle includes mounting bases, not visible in FIG. 2, for mounting two linear slides oriented in the slow scan direction. At the bottom of the right supporting end, the print head shuttle includes one mounting base indicated as mounting base 47 for mounting a single linear slide oriented in the same slow scan direction. The linear slides allow a movement of the print head shuttle in the slow scan direction. The print head shuttle movement along the slow scan direction may be driven by a linear motor, preferably linked to one of the linear slides.

The linear slides in turn may be mounted on a fast scan drive system to move the entire print head shuttle including the slow scan linear slides in the fast scan direction. This connection preferably uses ball joints to allow limited rocking or skew of the print head shuttle during movement, without introducing stress in the fast scan drive system or introducing distortions in the print head shuttle framework.

Other preferred embodiments may be used to provide both a fast scan movement and a slow scan movement of the print head shuttle relative to a printing table.

While preferred embodiments of the present invention have been described above, it is to be understood that variations and modifications will be apparent to those skilled in the art without departing the scope and spirit of the present invention. The scope of the present invention, therefore, is to be determined solely by the following claims.

The invention claimed is:

1. A print head mounting assembly for mounting and positioning a print head on a print head carriage framework suitable for being mounted in a printing system, the print head mounting assembly comprising:

a print head positioning device arranged to receive a print head; and a print head mounting tile having a mounting surface arranged to mount the print head positioning device thereon; wherein the print head positioning device is adjustably mounted onto the print head mounting tile which itself is adjustably mounted onto the print head carriage framework.

2. The print head mounting assembly according to claim 1, wherein the print head carriage framework includes mechanical references arranged to position the print head mounting tile relative to the print head carriage framework.

3. The print head mounting assembly according to claim 1, further comprising a leveling device arranged to adjust the position of the print head mounting tile relative to the print head carriage framework such that, when the print carriage framework is mounted in the printing system, the mounting surface of the print head mounting tile is level with a reference printing surface.

4. The print head mounting assembly according to claim 3, wherein the leveling device includes a spring loaded screw arranged between the print head mounting tile and the print head carriage framework.

5. The print head mounting assembly according to claim 3, wherein the mounting surface of the print head mounting tile is level with the reference printing surface within 20 μm.

6. The print head mounting assembly according to claim 1, further including a positioning device arranged to adjust the positioning of the print head positioning device on the mounting surface of the print head mounting tile.

7. The print head mounting assembly according to claim 6, wherein the print head positioning device is positioned with a resolution of 3 μm or less, and with an accuracy relative to another print head positioning device of another print head mounting assembly mounted on the print head carriage framework of 5 μm or less.

8. A print head shuttle comprising a print head mounting assembly according to claim 1, wherein the print head shuttle reciprocates across a print medium positioned coplanar with a reference printing surface.

9. A printing system comprising a print head mounting assembly according to claim 1.

10. A method of mounting a print head onto a print head carriage framework comprising the steps of:

providing a print head positioning device arranged to receive a print head, and mounting the print head in the print head positioning device;

providing a print head mounting tile having a mounting surface arranged to mount the print head positioning device thereon; and adjustably mounting the print head positioning device on the print head mounting tile, and adjustably mounting the print head mounting tile on the print head carriage framework.

11. The method according to claim 10, wherein the step of adjustably mounting the print head mounting tile includes leveling the mounting surface of the print head mounting tile, such that, when the print carriage framework is mounted in a printing system, the mounting surface of the print head mounting tile is level with a reference printing surface.

12. The method according to claim 11, wherein the step of adjustably mounting the print head positioning device includes positioning the print head positioning device onto the mounting surface of the print head mounting tile.

* * * * *